US006639368B2

(12) United States Patent
Sheoghong

(10) Patent No.: US 6,639,368 B2
(45) Date of Patent: Oct. 28, 2003

(54) PROGRAMMABLE PWM MODULE FOR CONTROLLING A BALLAST

(75) Inventor: Wang Sheoghong, Yorktown Heights, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 10 days.

(21) Appl. No.: 09/897,329

(22) Filed: Jul. 2, 2001

(65) Prior Publication Data

US 2003/0001521 A1 Jan. 2, 2003

(51) Int. Cl.[7] ..... H05B 39/04
(52) U.S. Cl. ..... 315/291; 315/224; 315/194
(58) Field of Search ..... 315/291, 292, 315/224, 194, 195, 344, 293, 307

(56) References Cited

U.S. PATENT DOCUMENTS 6,040,661 A * 3/2000 Bogdan ..... 315/224
6,188,181 B1 * 2/2001 Sinha et al. ..... 315/293
6,225,759 B1 * 5/2001 Bogdan et al. ..... 315/291
6,388,398 B1 * 5/2002 Li et al. ..... 315/194

FOREIGN PATENT DOCUMENTS

WO WO9912399 11/1997 ..... H05B/37/00
WO WO0035252 12/1999 ..... H05B/41/00

* cited by examiner

*Primary Examiner*—Don Wong
*Assistant Examiner*—Ephrem Alemu
(74) *Attorney, Agent, or Firm*—Steven R. Biren

(57) ABSTRACT

A programmable Pulse Width Modulation (PWM) generator is disclosed wherein a single module provides four different signals utilized to control a ballast for a light device. By changing the value in a single register, various waveforms are achieved.

10 Claims, 10 Drawing Sheets

PROGRAMMABLE PWM MODULE FOR CONTROLLING A BALLAST

TECHNICAL FIELD

The present invention relates to the control of lighting systems, and more specifically, to an improved method and apparatus for controlling a ballast to drive a lighting device or similar such device.

BACKGROUND OF THE INVENTION

Pulse Width Modulation (PWM) generators are used in a variety of applications to control power delivered to an electronic device. In the control of a ballast for use in driving a electronic lighting or similar device, one of four different modes is typically utilized. More specifically, the control circuitry for the ballast usually generates one of four different sets of signals, and wherein the mode defines the particular relationship of two different sequences of pulses (i.e. wave forms) that emanate from the control circuitry and are utilized to drive the ballast. The two control waveforms are then input into the gates of different transistor switches, turning the switches off and on to generate the required pulse width modulated signal. The two waveforms are therefore referred to as G1 and G2, since they are used as gating signals to two different switches. The switches are usually implemented as transistors.

In the first mode, the waveforms shown as 201 in FIG. 2 are generated. The control waveforms G1 and G2 utilized in additional modes are depicted as 202 through 204, respectively in FIG. 2. The four different modes all generate the two gating signals G1 and G2, but these are differences between the modes.

As shown in FIG. 2, in the first mode the waveforms are opposites of one another, no offset or delay between the two. In a second mode 202, the waveforms are separated by a delay of T3 between the end of G1 and the beginning of the pulse G2. In mode three, the wave forms are also separated by a delay T3, but the pulse width of the two waves is different between the two waveforms, and in mode four the waveforms are overlapping and of different widths.

In practical systems, such as those utilized by the assignee of the present invention, the four sets of waveforms described herein are suitable to meet the command and control needs of most systems.

Typically, the control waveforms are generated using either analog or hardwired digital circuitry. An analog implementation conventionally uses a voltage-controlled oscillator (VCO) and an analog comparator to control a pulse width based upon an analog feedback loop. A digital PWM control circuit is typically implemented using a digital counter and register.

The digital implementation is normally preferred due to its increased accuracy and the fact that it is not as susceptible to temperature changes, etc. However, to date, there does not exist a flexible PWM generator that can create any of the required four waveforms, and which also includes reliable protection circuitry. There exists a need for such a system, along with the ability to change modes for different types of operation.

SUMMARY OF THE INVENTION

The above and other problems of the prior art are overcome in accordance with the present invention. More specifically, a multi-function PWM module is designed to generate any of several waveforms that may be utilized to drive a ballast.

The inventive technique uses a programmable set of registers in combination with configurable logic circuitry in order to emulate different hardware arrangements that would otherwise generate a specific one of the four possible sets of waveforms.

In the preferred embodiment, values are programmed into a control register, and such values are then used to configure the logic circuitry for a specified delay and offset with respect to two signals.

BRIEF DESCRIPTION OF THE DRAWINGS

FIG. 2 shows a set of waveforms that may be used to drive an electronic ballast of the type that the present invention may be used in conjunction with;

DETAILED DESCRIPTION OF THE PREFERRED EMBODIMENT

Figure 1:
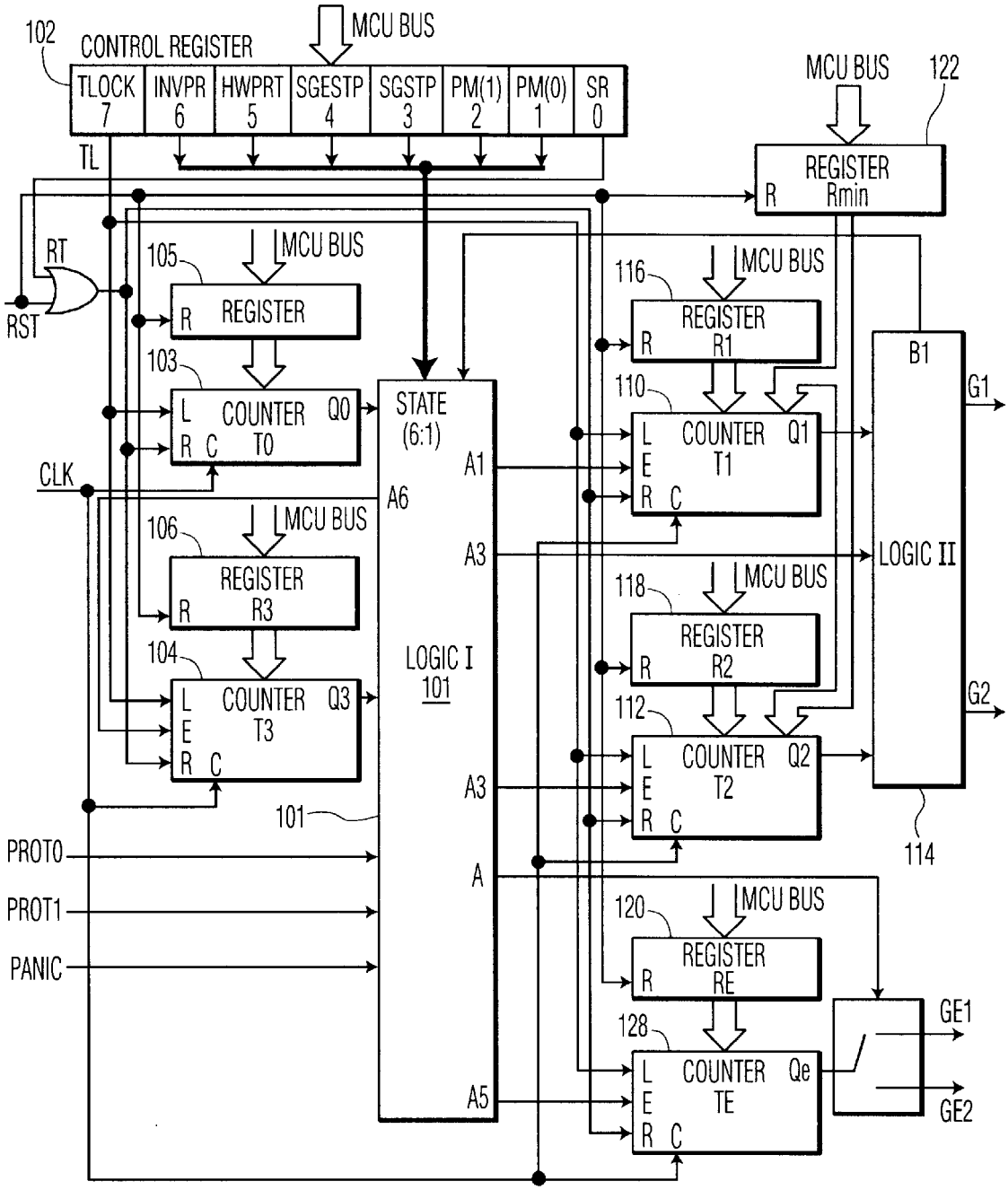
FIG. 1 depicts an exemplary hardware and functional diagram of an exemplary embodiment of the present invention.

FIG. 1 depicts an exemplary block diagram of an arrangement in accordance with the present invention. The arrangement comprises basic logic circuitry 101 that may be implemented utilizing discrete components, and a programmable logic array, or other similar arrangement. The system of FIG. 1 also includes a control register 102 for storing various values described below and loading those values for use by logic circuitry 101. Counters 103 and 104 and registers 105 and 106 serve to apply the relevant signals for use in circuitry 101. Counters 110 and 112 feed the output logic 114 as shown in order to generate the signals G1 and G2. These counters are loaded via registers 116 and 118 as shown.

The storage locations 0 through 7 in control register 102 contain the information for operating the PWM module. SR position 0 is software reset with functions to reset all counters and registers, other than the control register, to 0. Locations 1 and 2 designated PM (0) and PM (1) represent two bits utilized to specify the particular one of the four possible modes that should be utilized to generate the signals C1 and G2. Locations 3 and 4 represent synchronous stop bits for the signals C1, G2 and the signals GE1 and GE2 (GE1 and GE2 used for electrode heating control).

Locations 5 through 6 of control register 102 represent protection control bits, which serve to set a maximum voltage to be delivered. This protects the circuitry in the event the PWM duty cycle becomes large enough to otherwise produce an overvoltage condition. Finally, location 7 is labeled T lock, and represents a timing parameter lock control bit. The T lock location is set when all other parameters for the PWM signal are valid. This prevents the PWM signal from starting until all parameters for the signal are correctly set.

Registers 105, 106, 116, 118 and 120 are utilized to set the various timing, frequency, and pulse width parameters for the generation of waveforms G1 and G2. More specifically, in the exemplary embodiment, register 105 represents the frequency of the PWM signal to be generated. Register 116 is a parameter T1, which represents the pulse width of signal G1. Register 118 is a parameter denoted T2, which represents the pulse width of G2. Finally, register 106 is a parameter T3, which is set equal to the desired delay between G1 and G2 pulses in order to obtain the proper off-set.

The register 120 is used to store a parameter TE, which is a desired pulse width of GE1/GE2. GE1 and GE2 are used for electrode heating control, rather than ballast control. Register 122 stores the value of the minimum pulse width in order to provide protection of the circuit in the case of an overvoltage condition.

All counters shown as 103, 104, 110, 112, and 128 are binary programmable counters. The counters utilize numbers stored in their associated registers are shown and then count up to or down from those numbers in order to generate the required pulse width timers, delays, etc.

The operation of the system in the four different desired modes will now be described with reference to FIG. 1 through FIG. 4.

Figure 2:
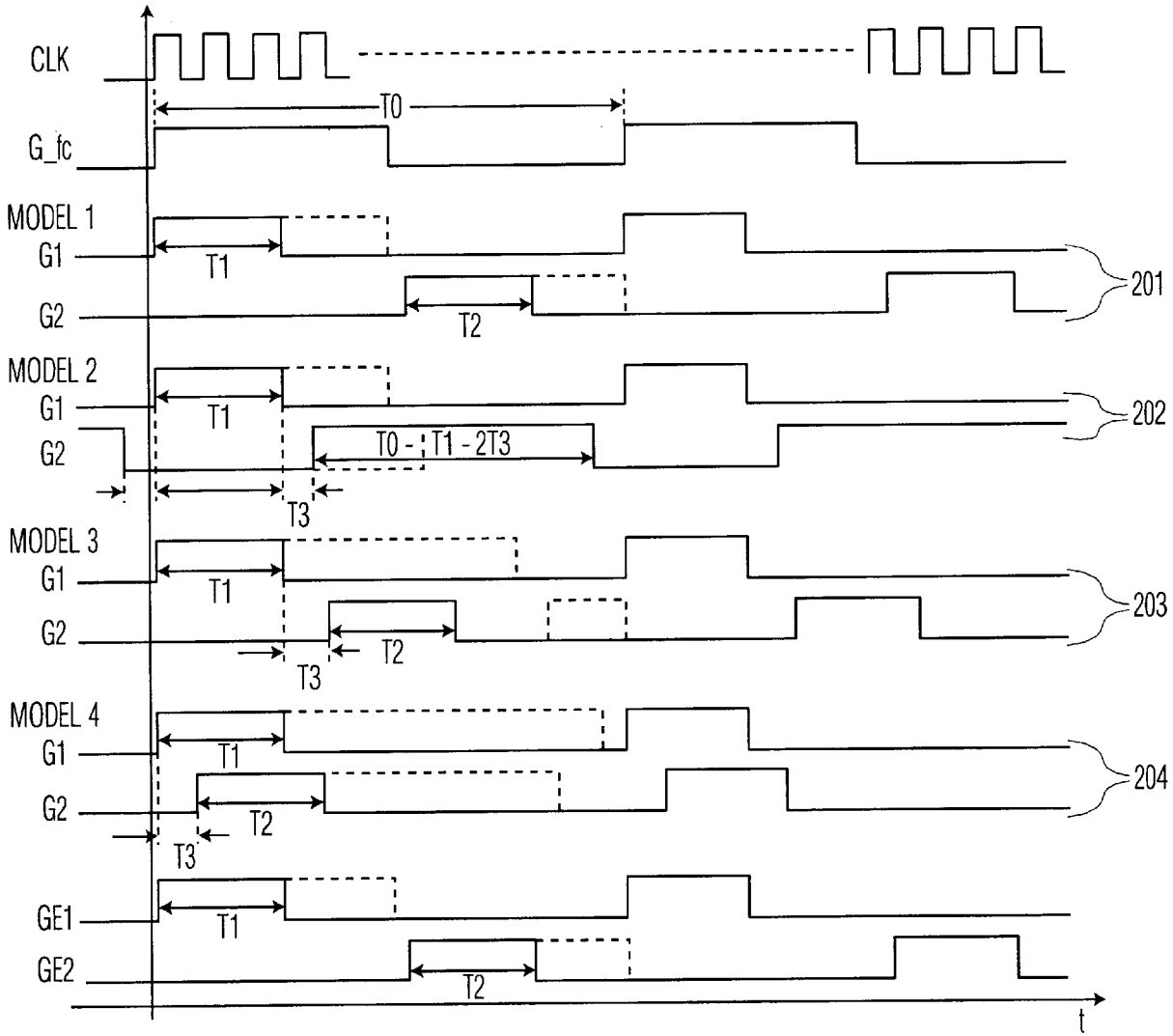
Figure 3:
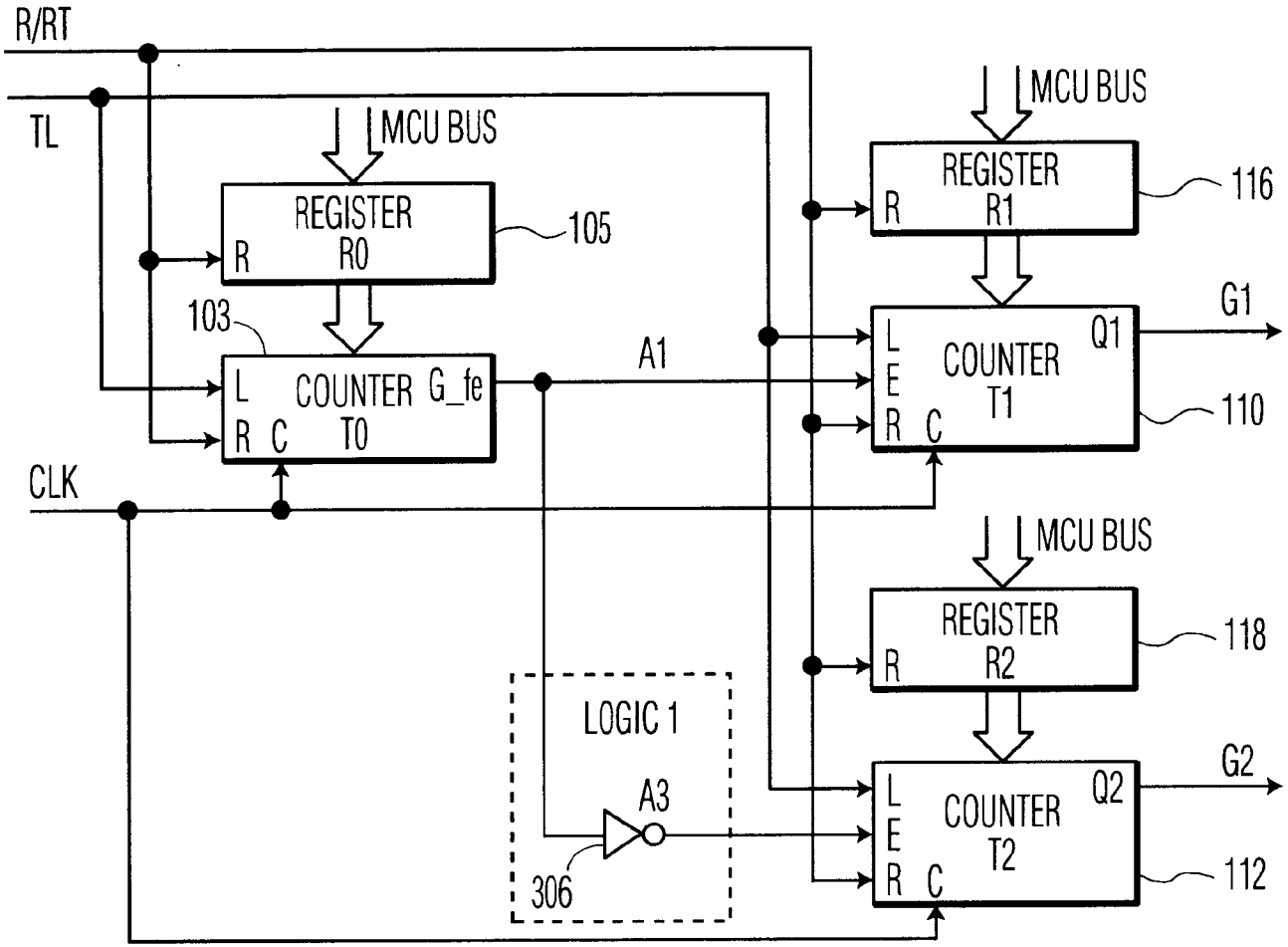
FIG. 3 depicts an exemplary arrangement that can be used to generate the signals required for a first mode of operation of the present invention.
Figure 3A:
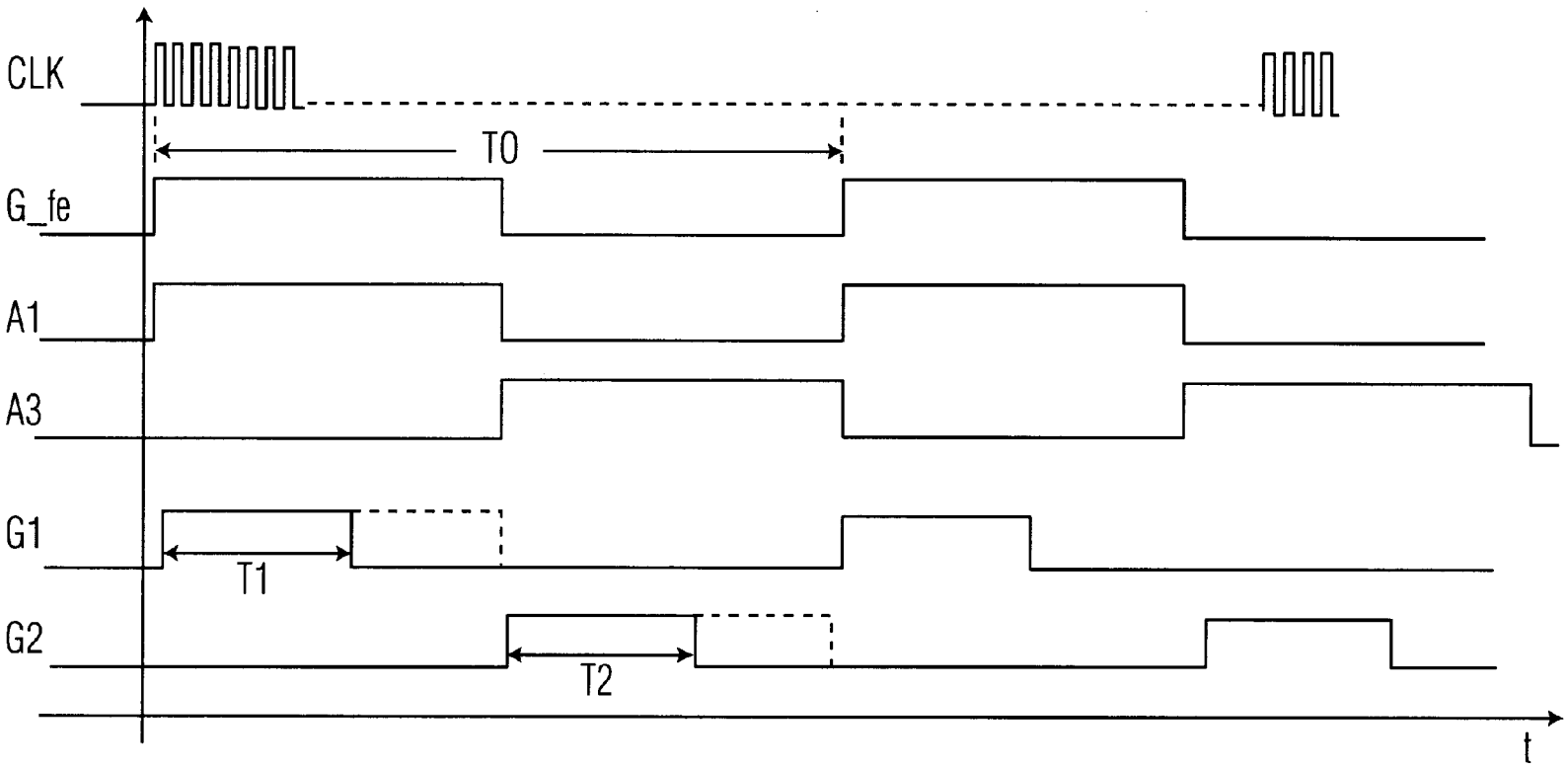
FIG. 3A depicts a timing diagram of several signals utilized in said first mode.

In mode one, it is desirable to generate the waveforms indicated as 201 in FIG. 2. When control register 102 is set to implement mode 1, logic 101 is in the state shown in FIG. 3. The remaining elements of FIG. 1 are not utilized in mode 1. The timing diagram of the system shown in FIG. 3 is shown in FIG. 3A. The operation of the PWM module in mode 1 is as follows: During the time designated when G_FC=1, A1 remains high and A2 is low. The counter 110 is enabled and counter 112 is disabled. Since register 116 represents the pulse width of G1, output Q1 of counter 110 will remain high until counter 110 finishes counting. Counter 110 will then stop counting and set G1 equal to 0.

As indicated in the timing diagram, FIG. 3A, the second counter 112 will then begin counting after pulling G2 up to a logical high. When T2, the value in counter 112 is reached, the counter will stop counting and set G2 back to 0 as shown in timing diagram of FIG. 3A. The dashed lines in FIG. 3A show the possible length of each of signals G1 and G2. It can be appreciated that the operation in mode one provides that G1 and G2 are separate non-overlapping pulse trains and that each is typically the inverse of the other.

Figure 4:
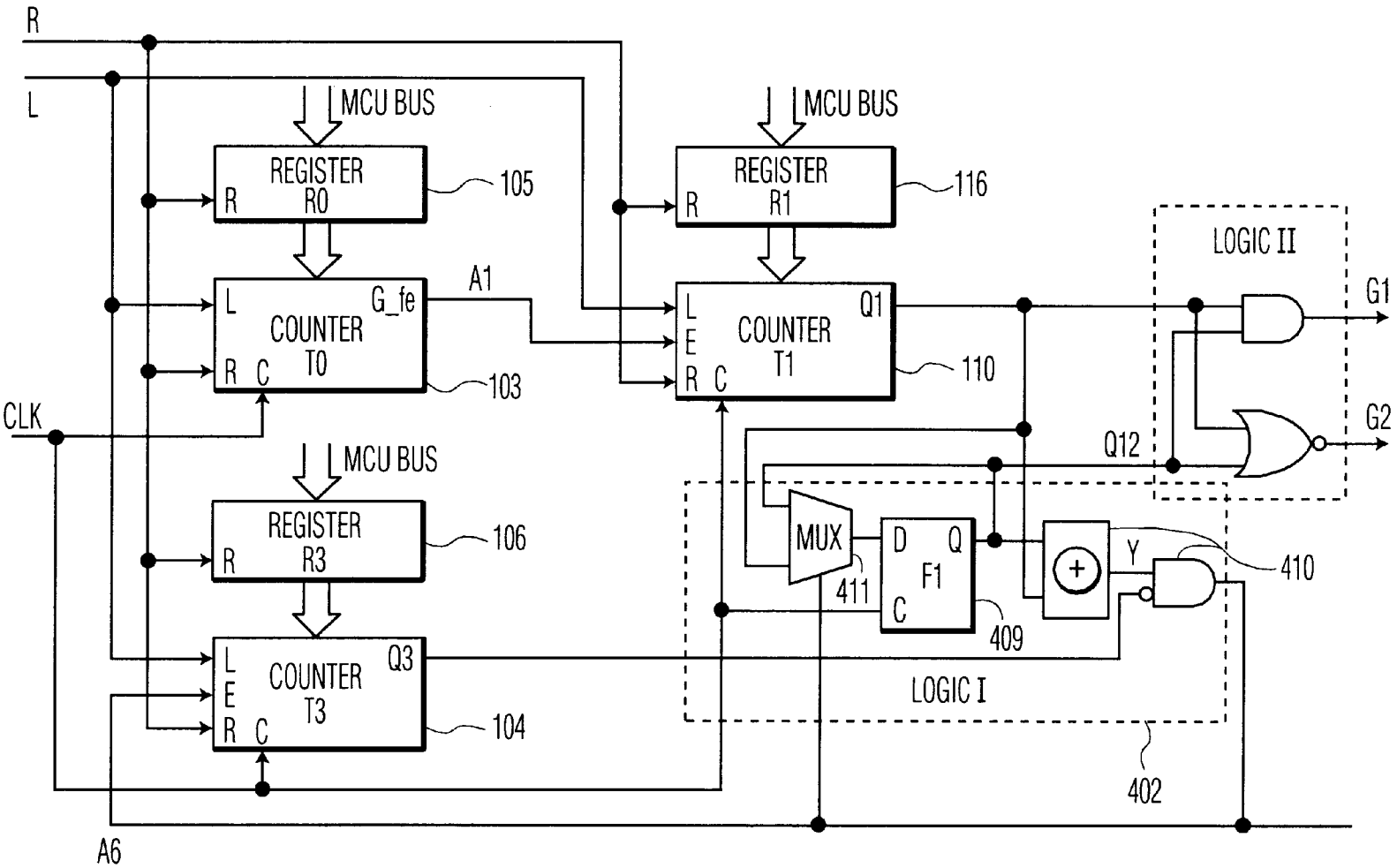
FIG. 4 depicts an exemplary arrangement that can be used to generate the signals required for a second mode of operation of the present invention.
Figure 4A:
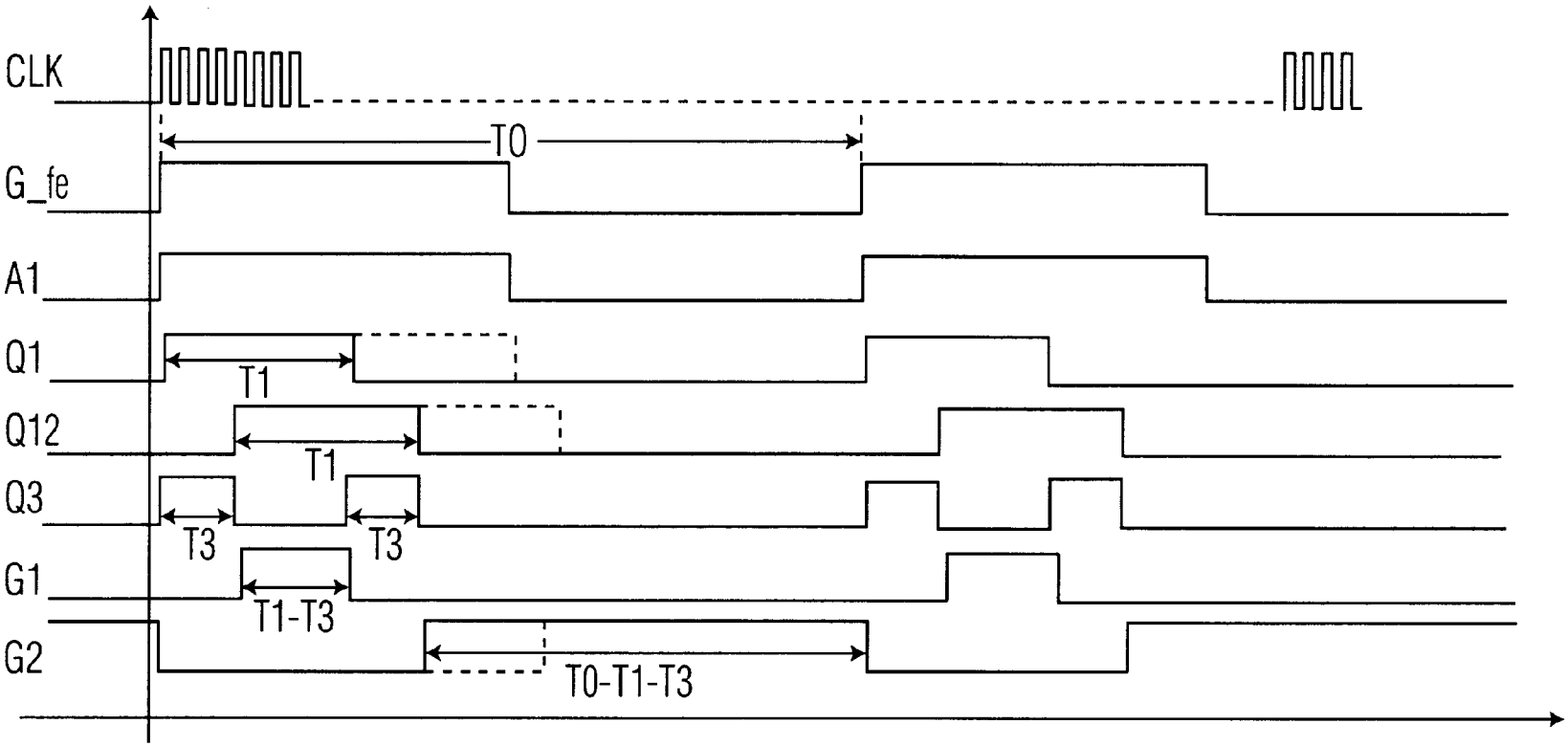
FIG. 4A depicts a timing diagram of several signals utilized in said second mode.

Mode two is depicted in FIG. 4, with the corresponding timing diagram depicted below in FIG. 4A. Note that unlike the previous mode of operation, the arrangement of mode two includes the signals generated by counter 104, and thus causes the delay shown as T3 in the timing diagram of FIG. 4A. During the operation of the system in mode two, counters 104 and 110 are enabled and start counting. When the appropriate delay time T3 is reached, counter 104 will stop counting and place a logical low on output Q3. This will cause signal G1 to be placed high for a duration set by T1. When G1 goes low, the circuitry of FIG. 4 causes an additional delay of T3 before placing it high on signal G2. Thus, the two signals G1 and G2 represent square pulse trains separated by a delay T3.

The additional logic shown in FIG. 4 is not the same as that of FIG. 3. Instead, the additional logic 402 implements the delay T3 through a latch 409, logic gates 410, and a mutiplexer 411 as shown. The particular implementation of the appropriate logic is not material, and those of skill in the art will readily be able to implement the proper logic functions to generate a specified delay T3 between signals.

Figure 5:
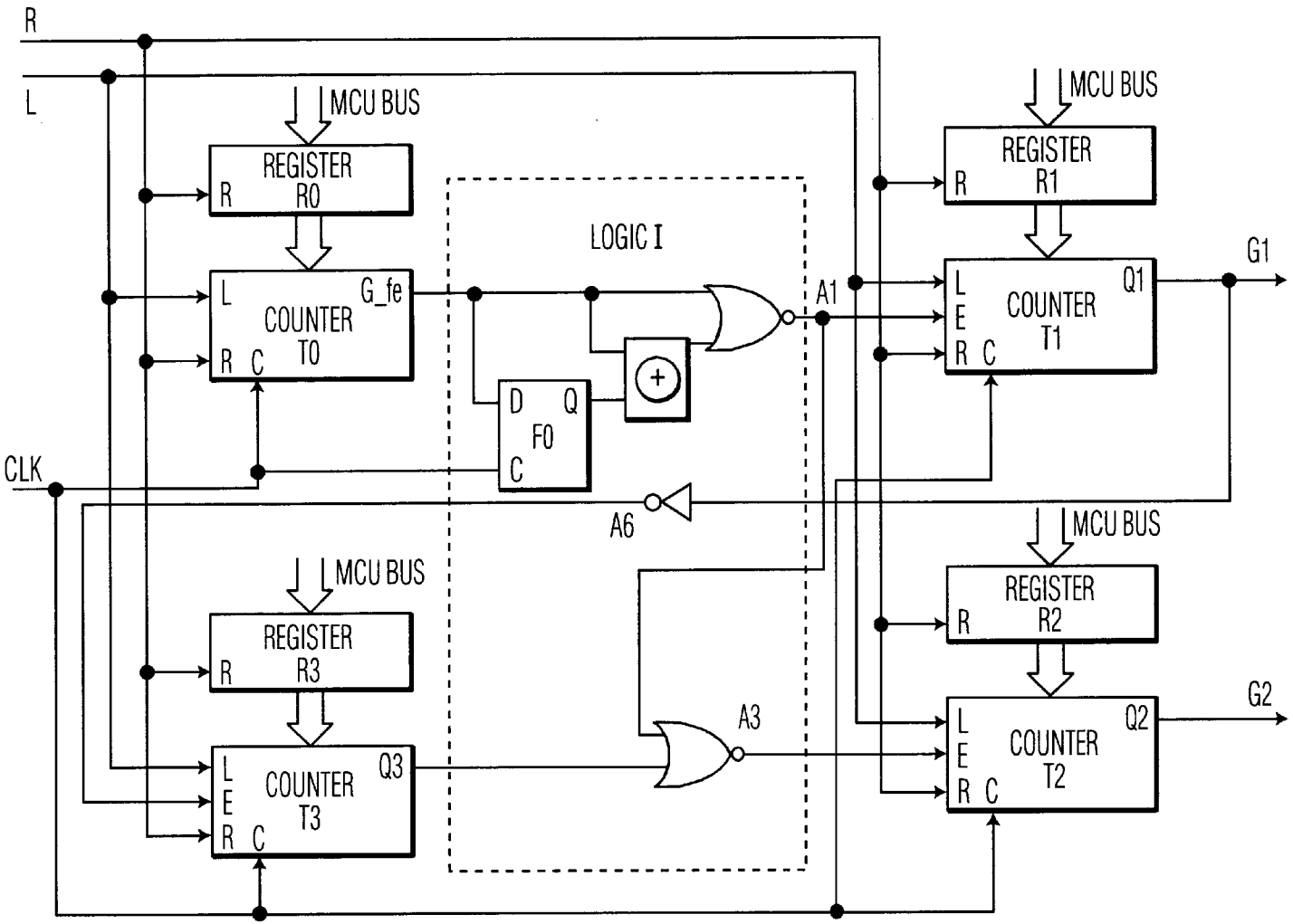
FIG. 5 depicts an exemplary arrangement that can be used to generate the signals required for a third mode of operation of the present invention.
Figure 5A:
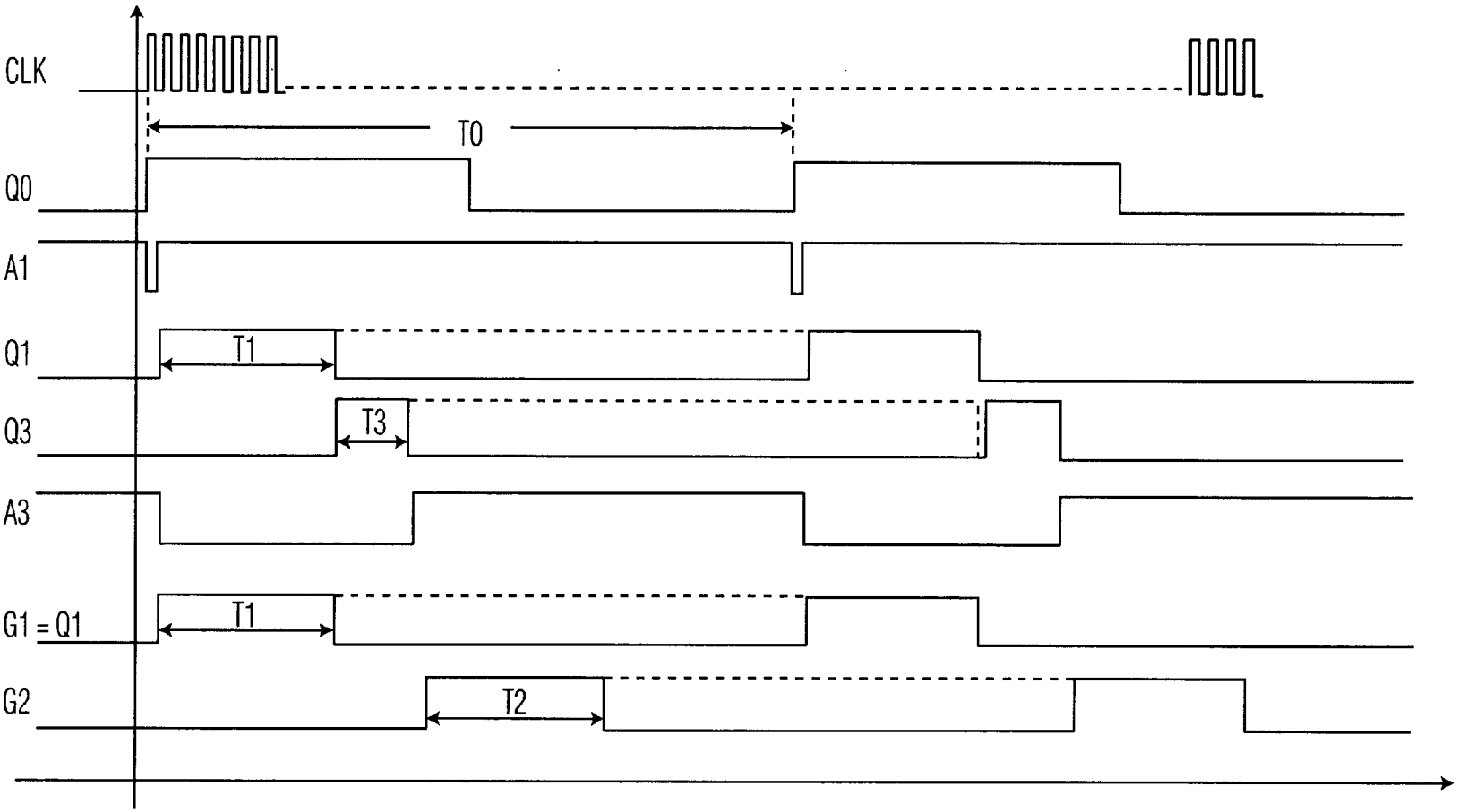
FIG. 5A depicts a timing diagram of several signals utilized in said third mode.

In a third mode shown in FIG. 5, the equivalent circuit established by programming the appropriate state into locations 1 and 2 of register 102 is depicted. As can be seen from the timing diagram of FIG. 5A, mode three is intended to generate pulse trains G1 and G2 separated by a delayed T3 but wherein the pulse trains may overlap and thus be on at the same time. Additionally, the pulse trains may be different lengths. In operation, a small negative pulse A1 is produced as shown in FIG. 5A. This causes counter 110 to begin counting in an amount sufficient to designate T1, with a pulse G1. After Q3 maintains the appropriate delay T3 as defined by counter 104, the counter 112 will count out the appropriate amount to T2, in order to set the width of the pulse G2. Thus, the system generates two pulse trains delayed from each other by a distance T3, and the width of each is independent of the other. Additionally, the duty cycle can be as much as needed, even if greater than 50% of the entire cycle of the PWM signal.

Figure 6:
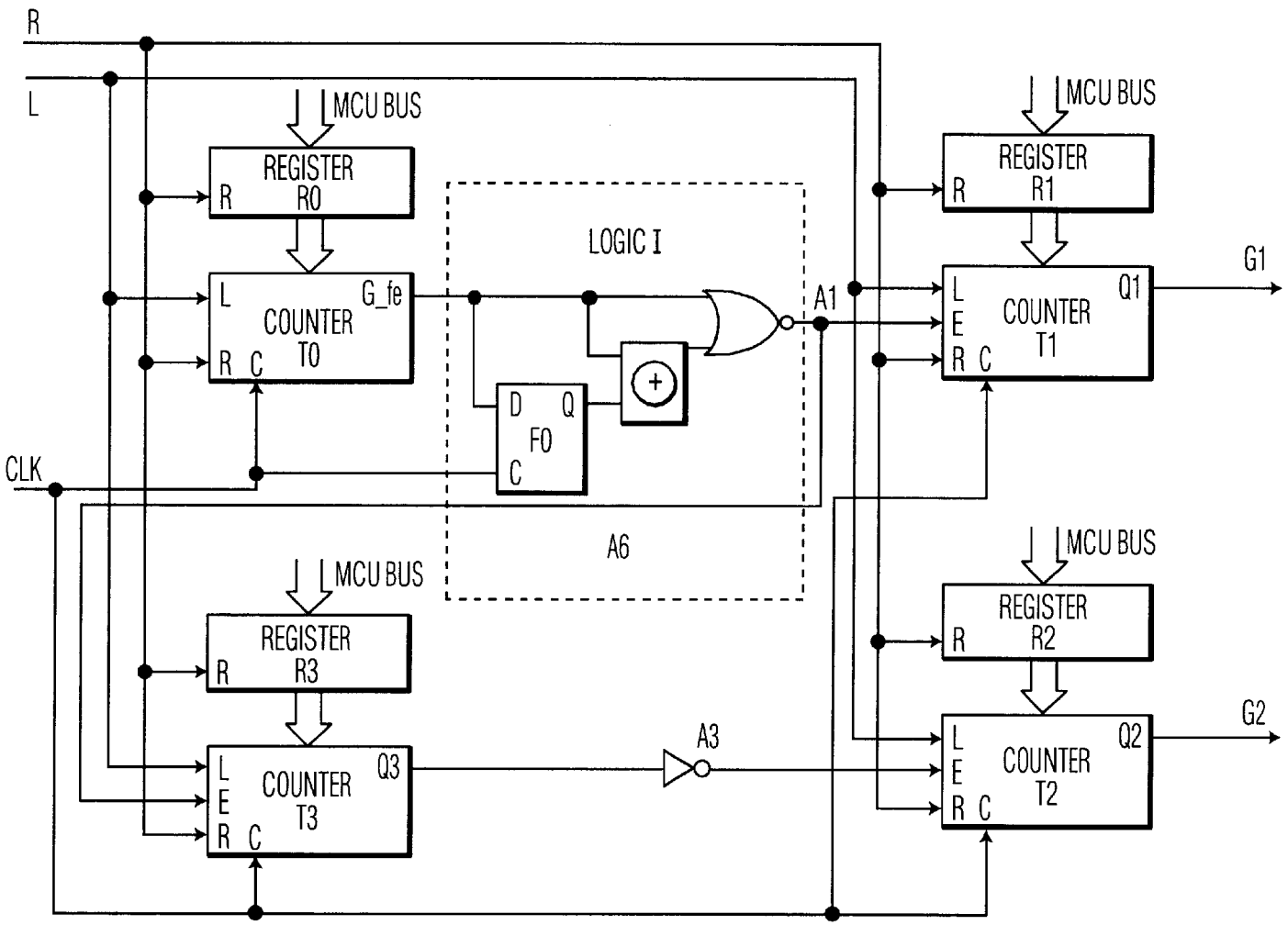
FIG. 6 depicts an exemplary arrangement that can be used to generate the signals required for a third mode of operation of the present invention.
Figure 6A:
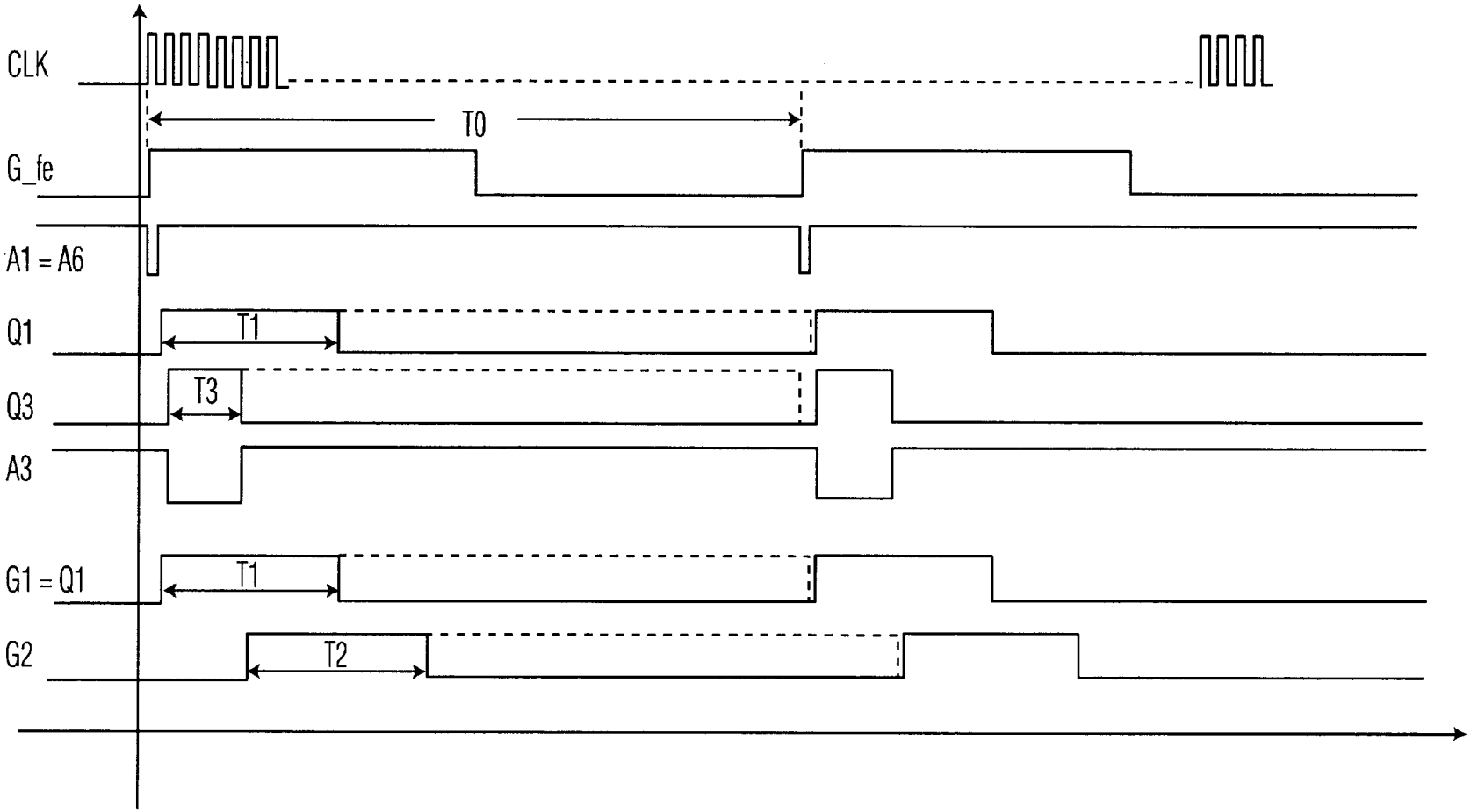
FIG. 6A depicts a timing diagram of several signals utilized in said third mode.

Finally, mode four of the operation is depicted in FIG. 6, with the corresponding timing diagram in FIG. 6A. Mode 4 allows the width of G1 and G2 to be over 50% of the entire cycle of each of the signals, and also allows G1 and G2 to be overlapped by an amount set by T3. All four possible sets of signals needed for ballast control may be generated.

It can be appreciated from the above that any of the four desired modes may be generated in a single logic circuit and from the same clock and signal sources. Thus, changing the mode of operation is a simple matter of software programming.

The above describes the preferred embodiment of the invention, but various modifications will be apparent to those of skill in the art. Such modifications include utilizing different circuitry for generation of the signals.

What is claimed is:

1. Apparatus for generating a set of signals to control an electronic ballast, said apparatus comprising a control register for accepting plural states, each of which represents a mode in which said signals are generated, wherein said control register is connected to a set of logic gates, and wherein the state in said control register is utilized to configure the logic gates to implement one or more of (1) a delay between signals and (2) an overlap of signals in time.

2. Apparatus of claim 1 wherein said delay is of an amount of time programmed into a register, and said register is connected to a counter to load a value from said register into a counter and thereby determine said amount of time of said delay.

3. Apparatus of claim 2 wherein said signals are pulse width modulated (PWM) signals.

4. Apparatus of claim 3 further comprising a second register that stores a value indicative of a frequency at which said PWM signal should be generated.

5. Apparatus of claim 4 further comprising a third register, that stores a value indicative of a width of a pulse in said pulse width modulated signal.

6. A method for driving an electronic ballast comprising providing a module having a control register connected to a set of logic gates, generating a set of signals to control said electronic ballast through the steps of utilizing a state in said control register for configuring said logic gates to implement one or more of (1) a delay between signals and (2) an overlap of the signals in time.

7. The method of driving an electronic ballast according to claim 6, further comprising programming a computer to determine whether said set of signals should be (1) delayed by an offset with respect to each other or (2) overlapping in time with respect to each other.

8. The method of claim 7 wherein said programming comprises facilitating the storage of plural values in plural registers, said values representing a delay between signals, a length of a pulse, and a frequency at which to generate pulses.

9. The method of claim 8 further comprising utilizing a logic module that reads values from a control register, and in response to said reading, configures one or more logic gates included therein to implement a delay, if any, and an offset, if any, in response to information stored in said control register.

10. The method of claim 8 further comprising the step of programming an additional register with an amount equal to a minimum pulse width of a PWM signal in the event of a fault.

* * * * *